United States Patent [19]

Smith et al.

[11] 4,372,380

[45] Feb. 8, 1983

[54] METHOD FOR DETERMINATION OF FRACTURE CLOSURE PRESSURE

[75] Inventors: Michael B. Smith; Kenneth G. Nolte, both of Tulsa, Okla.

[73] Assignee: Standard Oil Company (Indiana), Chicago, Ill.

[21] Appl. No.: 238,877

[22] Filed: Feb. 27, 1981

[51] Int. Cl.[3] ..... E21B 47/06; E21B 43/26

[52] U.S. Cl. ..... 166/250; 73/155; 166/308

[58] Field of Search ..... 166/250, 252, 308, 271, 166/259; 73/155

[56] References Cited

U.S. PATENT DOCUMENTS

| | | | |
|---|---|---|---|
| 2,792,709 | 5/1957 | Bell et al. | 73/155 |
| 2,818,728 | 1/1958 | Hartline et al. | 73/155 |
| 3,321,965 | 5/1967 | Johnson et al. | 73/155 |
| 3,410,137 | 11/1968 | Slover, Jr. et al. | 73/155 |
| 3,427,652 | 2/1969 | Seay | 166/250 |
| 3,550,445 | 12/1970 | Kiel | 166/250 X |
| 3,586,105 | 6/1971 | Johnson | 166/250 |
| 3,636,762 | 1/1972 | Kuo et al. | 73/155 |
| 3,690,167 | 9/1972 | Chase, Jr. et al. | 73/155 |
| 3,771,360 | 11/1973 | Prats | 73/155 |
| 4,192,182 | 3/1980 | Sylvester | 73/155 |

OTHER PUBLICATIONS

Felsenthal, "Step Rate Tests Determine Safe Injection Pressures in Floods", *The Oil and Gas Journal,* Oct. 28, 1974.

Earlougher, Jr., "Advances in Well Test Analysis," Marathon Oil Company, 1977.

*Primary Examiner*—Stephen J. Novosad
*Assistant Examiner*—George A. Suchfield
*Attorney, Agent, or Firm*—Scott H. Brown; Fred E. Hook

[57] ABSTRACT

A method of determining the minimum in-situ stress of an underground formation penetrated by a well. The method includes injecting a fluid at a certain rate into the formation to produce fractures in the formation, backflowing the injected fluid from the well at a rate less than the injection rate, and measuring the well fluid pressure decrease during the backflow to establish the pressure at which the fractures close.

6 Claims, 1 Drawing Figure

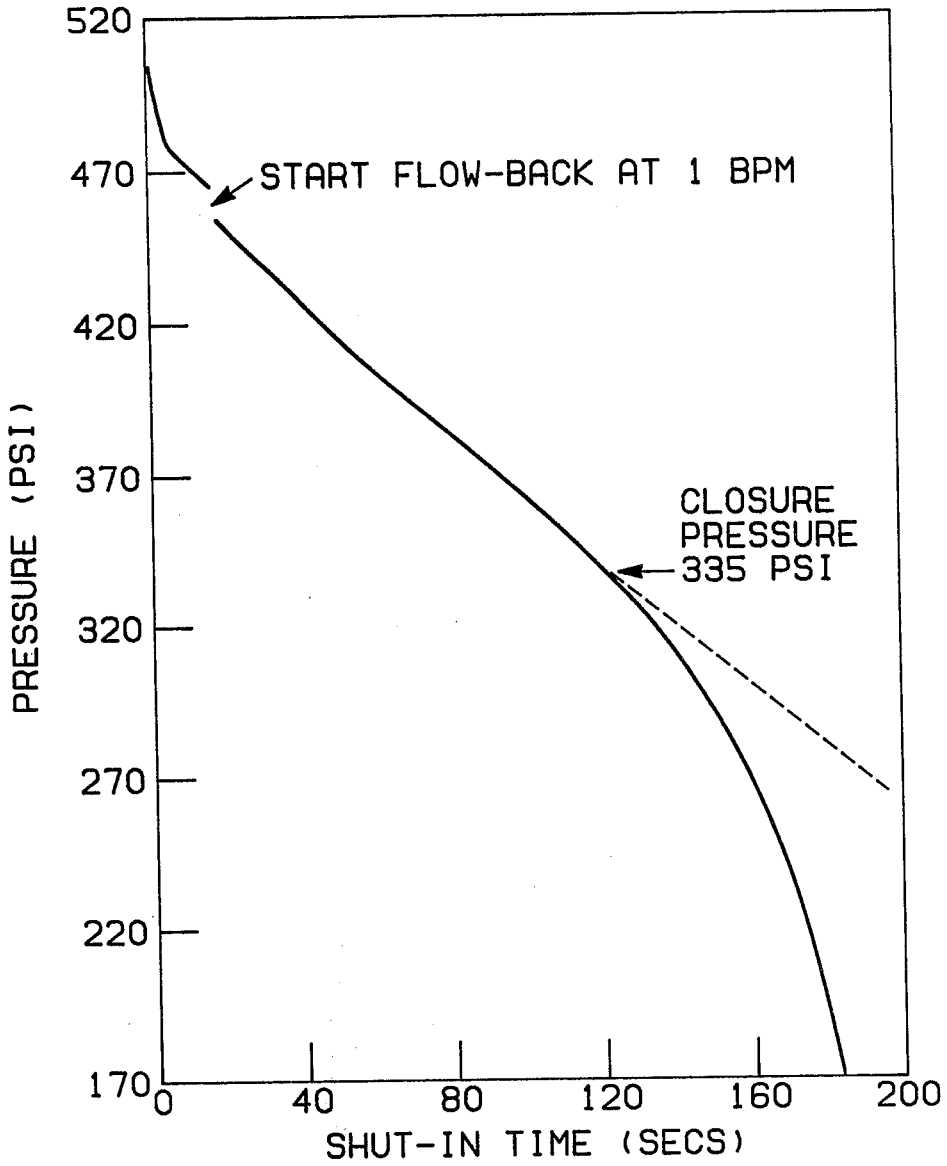
520
470
420
370
320
270
220
170
PRESSURE (PSI)
START FLOW-BACK AT 1 BPM
CLOSURE
PRESSURE
335 PSI
0
40
80
120
160
200
SHUT-IN TIME (SECS)

METHOD FOR DETERMINATION OF FRACTURE CLOSURE PRESSURE

BACKGROUND OF THE INVENTION

1. Field of the Invention

The present invention relates to a method for determining the minimum in-situ stress of an underground formation and, more particularly, to such a method which may be performed quickly, accurately, and without the necessity of specialized tools.

2. Setting of the Invention

Most producing oil or gas formations require some form of secondary recovery method after the production has decreased beneath a certain level. One such recovery method is by water drive where fluid is injected into producing formations to force the oil towards a production well. Pressure at which the fluid is injected is very important in the control of secondary and/or tertiary recovery projects. In certain situations it has been found that for best control, the fluid should be injected at a rate and pressure below the fracture parting pressure (also referred to as the minimum in-situ stress, fracture closure pressure or fracture gradient). This minimum in-situ stress is also important in the design and analysis of hydraulic fracturing stimulation projects.

In the past, for enhanced recovery operations, the in-situ stress has normally been determined by a "step-rate" test. In these tests the fluid injection rate is increased in small increments or steps and the resulting injection pressure is measured. At a certainrate, a plot of the pressure versus rate will show a decreasing slope, or the injection rate can increase with little or no increase in pressure. The pressure where this change in slope occurs is termed the fracture parting pressure or the in-situ stress. In actual practice, this procedure has not been very satisfactory because the test is time-consuming, and the data is often ambiguous.

Also, the inferred parting pressure is likely to be the fracture extension pressure (pressure to extend a fracture) which is greater than the pressure to open a fracture. The pressure to open the fracture is generally the desired pressure level for operations. A second procedure, which is used in fracture design work, involves straddle packers used in an openhole section. "Mini-breakdowns" are then pumped between the packers to measure the in-situ stress. This procedure provides accurate test results; however, this procedure requires an unfractured open hole and the test is subject to mechanical problems, such as packer leaks.

SUMMARY OF THE INVENTION

The present invention contemplates a novel method of determining the minimum in-situ stress of an underground formation, contemplated to overcome the disadvantages of the prior methods.

The present method comprises injecting fluid at a certain rate through a well into an underground formation to produce, or open existing, fractures in the formation. The well is then shut-in and backflowed at a rate less than the injection rate. During the backflow procedure, the rate of decrease of the fluid pressure is measured to establish the pressure at which the fracture is closed. The point where the rate of pressure decrease changes or increases, indicates the minimum in-situ stress.

The present method provides a simple procedure which may be accomplished in a short period of time and provides accurate data to establish the fracture parting pressure. The present method further may be used on cased and perforated wells and does not require any special tools or special surface equipment.

BRIEF DESCRIPTION OF THE DRAWING

The drawing is a graphic representation of well fluid pressure versus time, used to determine the minimum in-situ stress.

DETAILED DESCRIPTION OF PREFERRED EMBODIMENTS

The present invention is for a method of determining the minimum in-situ stress, or also referred herein as the fracture closure pressure of fracture parting pressure.

The procedure is initiated by pumping a certain volume and type of fluid into a well, penetrating an underground formation. Typically, the fluid is waste water used in waterflood projects, or may be special fracturing fluid. Fluid is pumped into the formation at a rate which is sufficient to insure the opening of fractures in the formation. Rate and fluid requirements for this procedure vary greatly from formation to formation. After the volume of fluid has been injected into the well, the well is shut-in, and a surface valve is opened to allow the well to backflow. The backflow rate should be less than the injection rate and the actual backflow rates will vary from formation to formation.

It has been found that backflowing at 10% of the injection rate is usually suitable for the purposes of this invention. Several different backflow rates may have to be utilized in order to produce pressure data which is appropriate to the formation.

This procedure requires that the fracture closure pressure be reflected by a positive surface pressure, that is, the fracture closure pressure cannot be less than the hydrostatic fluid pressure. In the event that the well goes "on vacuum", then a suitable downhole metering pump may be used to backflow the fluid to the surface. In highly porous sand formations, an injection rate of 10 bbls/min has been used with a backflow rate of 1 bbl/min and in tight gas formations, an injection rate of 0.5–1.5 bbls/min has been used and backflowed at 10% of the injection rate with accurate results.

The well pressure, and more accurately, the bottom-hole pressure, is measured and recorded during the backflow procedure, then is plotted versus time on a graph. An example is provided to illustrate the described method. A well in the Salt Creek Formation of Wyoming was used to test the described method with results from this test being shown in the attached drawing. Fifty barrels of fluid at 10 bbls/min was injected into the well, the well was shut-in and backflowed at 10% of the injection rate, or 1 bbl/min. As can be seen from the graph, the slope or rate of pressure decrease remained constant or decreased until approximately 120 seconds after shut-in. At approximately 123 seconds, the pressure decrease rate increased, which indicated that the fractures had closed. The pressure at which the fractures closed was 335 psi, indicating that this was the surface pressure which reflects the minimum in-situ stress. Obviously, the actual in-situ stress is found by the simple addition of a pressure equal to the fluid head down to the formation of interest.

A theoretical basis to the method is hereinafter set forth. At the instant the fluid injection ceases and the well is shut-in, the formation is accepting the entire injection rate through fracture extension and fluid leakoff. Thus, the backflow of approximately 10% has very little effect on the initial pressure decline. After a short period of time, the fracture extension will cease and the bottomhole pressure will decrease due to the fluid leakoff plus backflow. Due to the large surface area of the open fractures, the pressure decrease attributable to the leakoff to the formation should dominate. During this time, the rate of pressure decline is governed by the compressibility of the fractures. That is, as the fluid leaks off, the fractures will close, which maintains the pressure at a relatively high level.

When the fractures begin to close, two changes occur. First, the wellbore loses communication with the fracture area and the leakoff rate is reduced, thus the backflow rate becomes dominant. Secondly, the compressibility of the system changes and becomes, relative to the fractures, very small. Small changes in fluid volumes will then be reflected by large changes of pressures. At this point, the backflow rate is essentially flowing-fluid from an enclosed wellbore and the pressure drops rapidly. This dramatic increase in pressure decline rate then indicates the closure of the fractures and the pressure where this occurs is the minimum in-situ stress.

Whereas the present invention has been described in particular relation to the drawing attached hereto, it should be understood that other and further modifications, apart from those suggested herein, may be made within the scope and spirit of this invention.

What is claimed:

1. A method of determining the minimum in-situ stress of an underground formation penetrated by a well, comprising:

(a) injecting fluid at a certain rate into the formation to open fractures in the formation;

(b) backflowing the injected fluid at a rate less than the injection rate; and (c) monitoring the well fluid pressure during step (b) to establish the pressure at which the fractures close.

2. A method as in claim 1 wherein the injection fluid is well fracturing fluid.

3. A method as in claim 1 wherein the backflow rate is approximately 10% of the injection rate.

4. A method as in claim 1 wherein the well fluid pressure is the bottomhole pressure.

5. A method as in claim 1 wherein the decrease in well fluid pressure is monitored to establish a point of pressure rate change which indicates the closure of the fractures.

6. An improved method for determining the fracture closure pressure for waterflood control, comprising:

injecting fluid at a certain rate into the formation to positively open fractures in the formation;

shutting in the well;

backflowing the injected liquid from the well at a rate less than the injection rate; and monitoring the rate of decrease in the well fluid pressure to determine a point of pressure rate change indicating the closure of the fractures.

* * * * *